US006086359A

United States Patent [19]

Sher

[11] Patent Number: 6,086,359

[45] Date of Patent: Jul. 11, 2000

[54] LIGHTER WITH A SAFETY SYSTEM

[75] Inventor: Tak Chi Sher, Hong Kong, The Hong Kong Special Administrative Region of the People's Republic of China

[73] Assignee: Polycity Enterprise Limited, The Hong Kong Special Administrative Region of the People's Republic of China

[21] Appl. No.: 09/459,501

[22] Filed: Dec. 13, 1999

[51] Int. Cl.[7] ..... F23D 11/36

[52] U.S. Cl. ..... 431/153; 431/255

[58] Field of Search ..... 431/153, 255

[56] References Cited

U.S. PATENT DOCUMENTS 5,496,169 3/1996 Chen .

5,697,775 12/1997 Saito et al. .

5,865,614 2/1999 Hsu .

5,980,242 11/1999 Mary ..... 431/255

*Primary Examiner*—Carroll Dority

*Attorney, Agent, or Firm*—Jackson Walker L.L.P.

[57] ABSTRACT

A lighter safety system which in a first "safety on" position prevents the ignition of the lighter by blocking the depression of the lighter trigger. The simultaneous forward engagement of a safety pin with the operator's thumb and the rearward depression of the trigger by the operator's fingers (of the same hand) allows the lighter to ignite. The safety pin is pivotable about a positioning pillar in the housing. A hook on one end of switch engages on slanted slot in the trigger to prevent depression of the trigger until the pivotable switch pin is urged forward.

3 Claims, 6 Drawing Sheets

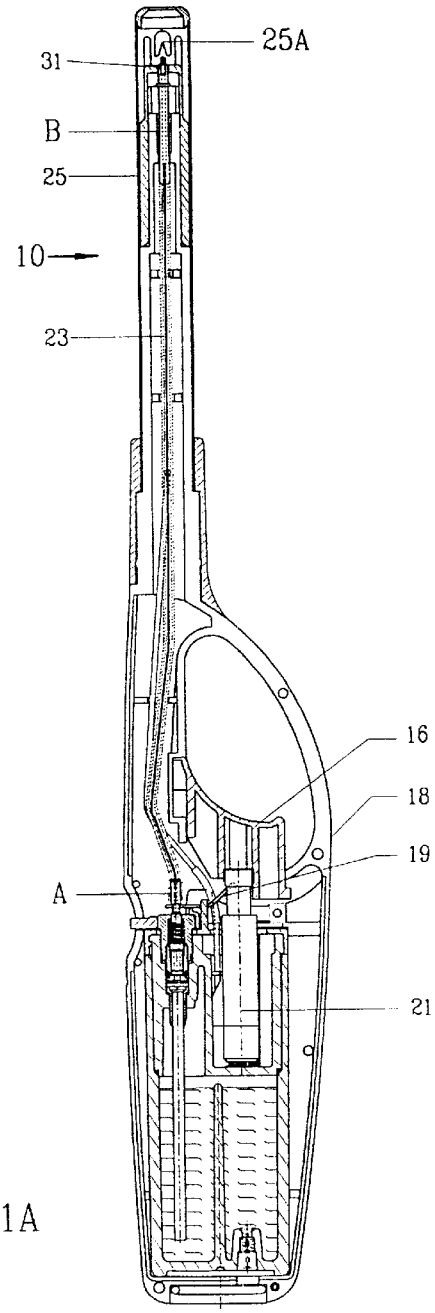
FIG 1A
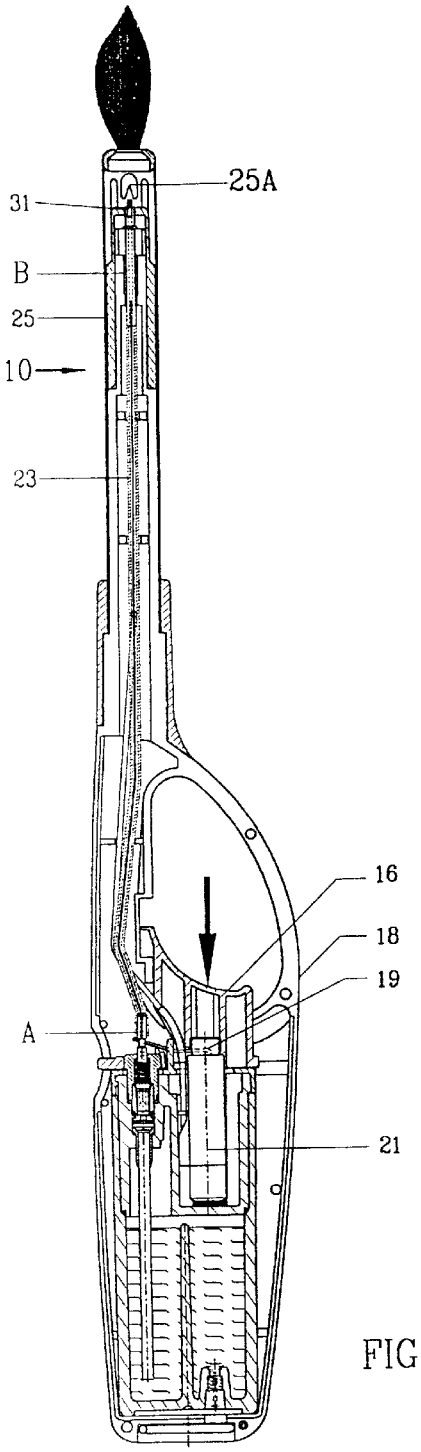
FIG 1B
FIG 1C
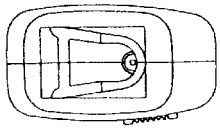
PRIOR ART

LIGHTER WITH A SAFETY SYSTEM

BACKGROUND OF THE INVENTION

The present invention relates to a lighter device, and more particularly to a unique safety system incorporated into the lighter. Specifically, the present invention relates to a push button safety switch which cooperates with an ignition trigger of the lighter to allow ignition of the lighter by coordinating the simultaneous deactivation of the safety and the engagement of the trigger.

Current safety switches on lighters are awkward to engage. Some switches are such that when the switch is moved to the "safety off" position to allow the operator to ignite the lighter, by pulling a trigger mechanism, the safety remains in the "safety off" position allowing for subsequent unprotected ignition attempts. This may be a dangerous condition if the lighter falls into the hands of a child. Since such safety switches do not automatically re-engage to the "safety on" position, a child could pull the ignition trigger and ignite the lighter.

Additionally, other prior art devices include U.S. Pat. Nos. 5,865,614; 5,697,775; and 5,496,169.

U.S. Pat. No. 5,697,775 illustrates and teaches a safety switch which requires the operator to press the safety switch downwardly while pulling the trigger rearwardly. While the device is difficult for children to use, it is an awkward operation for even adults to use. Further one embodiment of the device of U.S. Pat. No. 5,697,775 houses the safety switch in the trigger section of the lighter housing.

The present invention places the safety switch on top of the lighter housing outside and away from the trigger section. The present invention allows for the simultaneous engagement of the safety switch by urging the switch forward to the "safety off" position while the ignition trigger is pulled rearwardly. This requires a level of coordination not normally obtained by children, but still simple enough for adults. Thus, the operator simultaneously pulls the ignition trigger rearwardly with the forefinger of one hand and urges the safety switch forward with the thumb of the same hand. The lighter then lights. The safety switch may then be released and the flame continues. After the trigger is released, the flame is extinguished. The safety switch automatically returns to the "safety on" position preventing accidental ignition.

SUMMARY OF THE INVENTION

The present invention is a lighter having an ignition trigger operable within the lighter housing. A safety switch operable within the same housing but away from the trigger section, includes a pivotable safety pin movable from a first "safety on" position to a second "safety off" position. The pivot pin has an engagement foot on the distal end of the pin which blocks the ignition trigger from being pulled or activated to initiate ignition of the lighter. The engagement foot engages a slot in the trigger. A narrow leg extends upwardly from the engagement foot and is provided with a generally central opening to receive a positioning pillar which acts as the pivot point. When the top of the pin is urged forwardly along a generally longitudinal axis of the lighter while simultaneously with the pulling of the trigger oppositely along the same general longitudinal axis of the lighter, the narrow leg of the safety pin pivots and the foot disengages from the trigger slot. The trigger then may be pulled sufficiently to initiate lighter ignition. Thus, the simultaneous forward movement of the pin from "safety on" to "safety off" with the rearward pulling of the trigger along the same general longitudinal axis of the lighter activates the lighter. It is the arrangement and movement of the elements of the present invention which results in a safety system requiring a level of hand coordination not normally developed in a child and yet not so awkward as to inconvenience adults. Once the trigger is released, the pin automatically returns to the "safety on" position.

BRIEF DESCRIPTION OF THE DRAWINGS

FIG. 1A is a cross-sectional view of a prior art lighter, with the trigger not pulled.

FIG. 1B is a cross-sectional view of a prior art lighter, with the trigger pulled.

FIG. 1C is a bottom view of a prior art lighter.

DETAILED DESCRIPTION OF THE PREFERRED EMBODIMENT

Figure 2A:
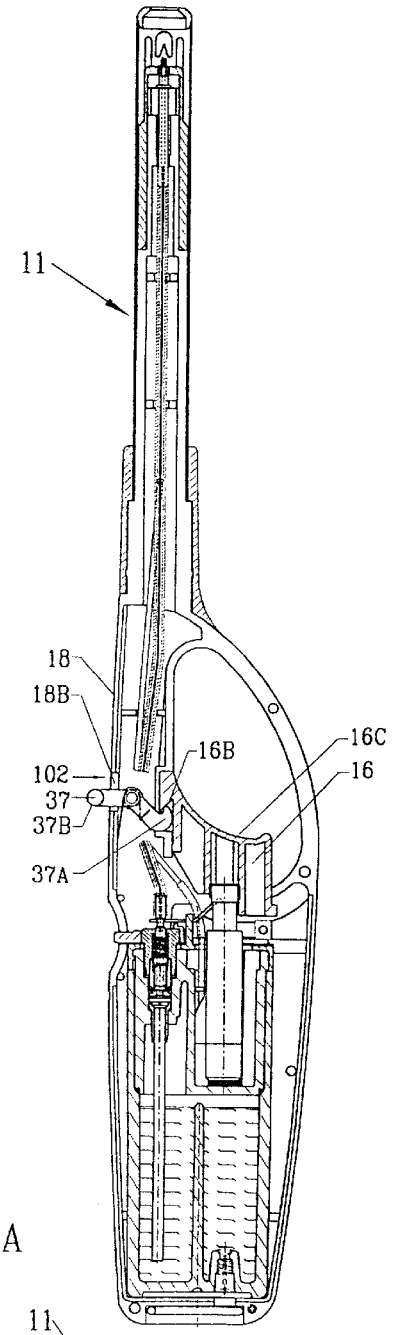
FIG. 2A is a cross-sectional view of the safety lighter of the present invention, with the trigger not pulled.

FIGS. 1A, 1B and 1C illustrate a typical prior art lighter 10 having an ignition trigger 16 operable within the lighter housing 18. The operation of such lighters is well-known in the art. The operator holds the lighter 10 by one hand and pulls or presses the trigger 16 with his or her finger. Movement of trigger 16 pushes the gas lever 19 downwardly which in turn elevates nozzle A to release gas. Gas is driven to upper end nozzle B through gas pipe 23. At the time the trigger 16 is depressed, piezoelectric actuator 21 is vibrated to emit an electric charge which is transmitted to conductive pipe 25 through its conducting wire.

Since pipe 25 is a conductor, an electric charge is conducted to pipe end 25A. Simultaneously, another electric circuit transmits the electric charge to nozzle B through the contact of the bottom of piezoelectric actuator 21A and ground wire 22. Because nozzle B is a conductor, electric charge is conducted to sparkling spring 31. When meeting a spark, the gas lights a flame 100.

Figure 2B:
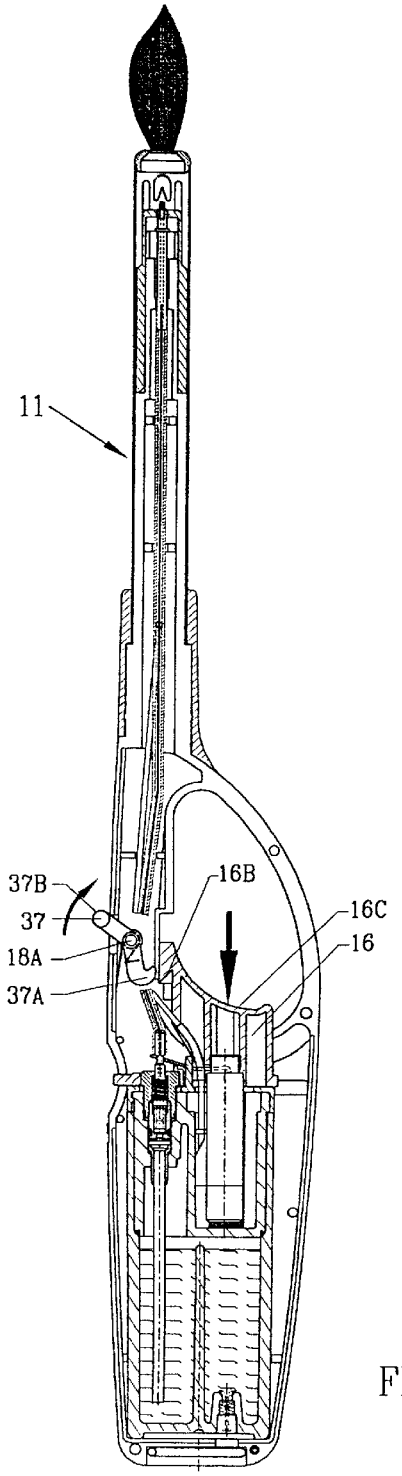
FIG. 2B is a cross-sectional view of the safety lighter of the present invention, with the trigger pulled rearwardly and the safety pin urged forwardly.
Figure 2C:
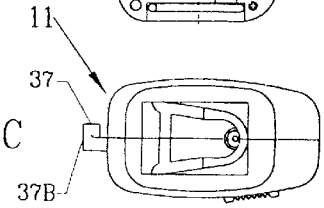
FIG. 2C is a bottom view of the safety lighter of the present invention.

The present invention is shown in detail in FIGS. 2A, 2B and 2C. The safety system 102 is built into the lighter 11 without any significant modifications to the existing prior art lighter 10. The safety switch is outside the trigger section and requires a forward pressure on the switch head or top and a rearward depression of the trigger to activate the lighter 11.

Figure 3:
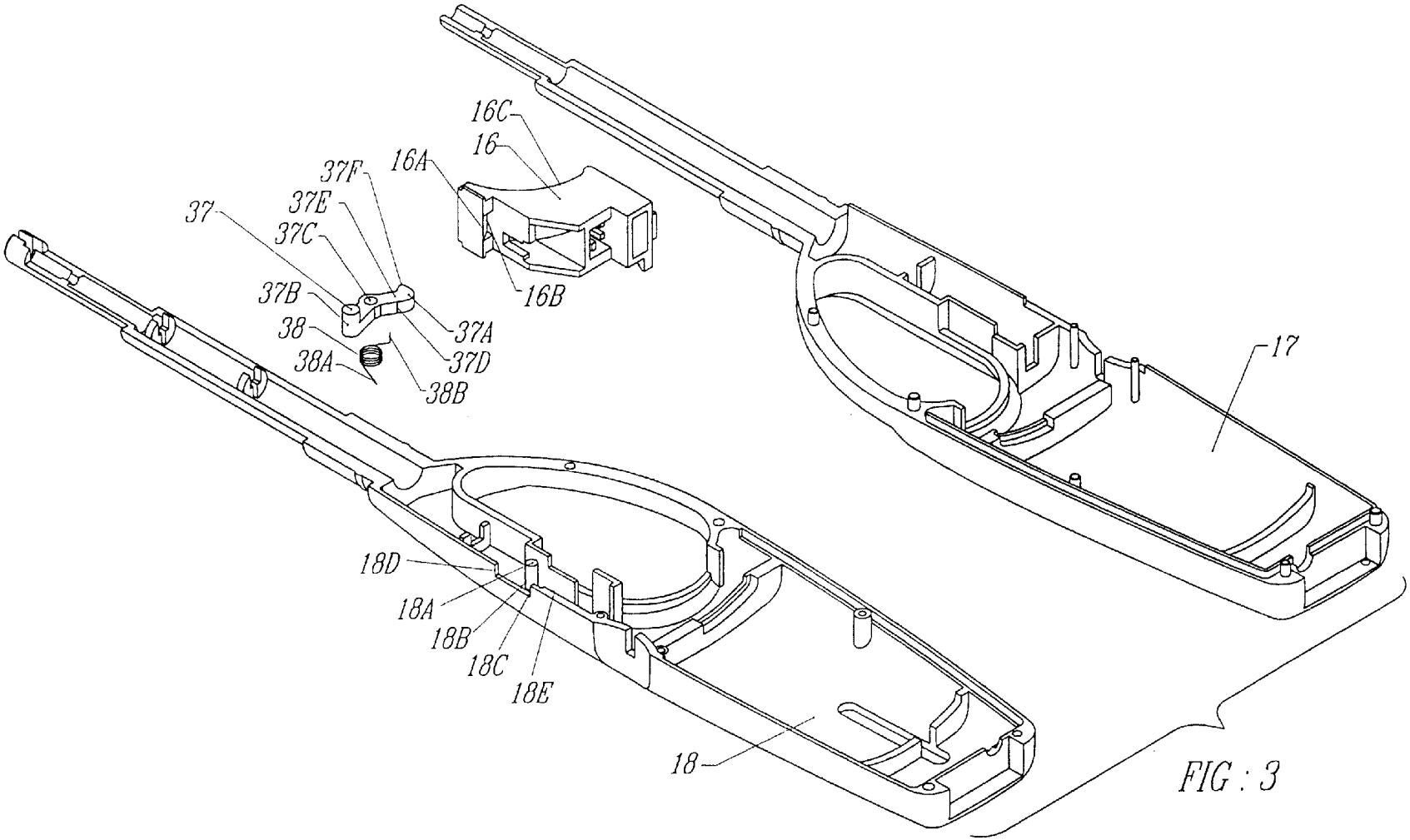
FIG. 3 is an exploded perspective view of the components of the safety system of the present invention.

The lighter housing 18 is designed to include an opening 18B on the top side of the lighter 11 for pivotal switch safety pin 37 whereas trigger 16 on the underside of the lighter in the trigger section is designed with a slanted slot 16B and a top edge 16A (FIG. 3). Additionally, a torsional switch spring 38 is designed for inclusion in the present invention to urge the safety pin 37 to the "safety on" position.

In FIGS. 3–6, most of the lighter parts are not shown so that the safety system 102 of the present invention may be more clearly observed. As may be seen in FIGS. 3–6, switch safety pin 37, switch spring 38, and trigger 16 are assembled in housing 18. Pivotal switch safety pin 37 is urged rearward to the "safety on" position under the spring action of spring 38. Top end 38A of the spring to comes in contact with inner bottom part 18E of housing 18 and lower spring end 38B applies torsional force against the front side 37D of narrow leg 37E of pin 37.

In this first position trigger top edge 16A and slanted slot 16B come in contact with hook 37F of engagement foot 37A. It is, therefore, not possible to press the trigger 16 rearwardly to ignite the lighter 11 because edge 16A of trigger 16 is blocked from rearward movement by engagement foot 37A. The sharp hook 37F engages into the slanted slot 16B to further secure the trigger from movement. Piezoelectric actuator 21 cannot be actuated nor can the gas lever 19 be raised to release gas. The lighter cannot be ignited under this first "safety on" position.

The top 37B of the pin 37 pivots forward as pin 37 rotates about the positioning pillar 18A which extends through a generally, central pivot opening 37C in pin 37. As may be seen in FIG. 3 the pillar 18 is generally cylindrical upstanding protrusion attached to a side wall of the housing 18. The pillar is aligned in housing opening 18B. Opening 18B has a front edge 18D and a rear edge 18C. As the pin 37 is urged forward its rotational movement is stopped by edge 18B. As will be seen below when the pin 37 is released, it springs back to its first position (FIG. 4) by the action of spring 38. Pin 37 is stopped in its return rotation by edge 18D.

Figures 4, 4A:
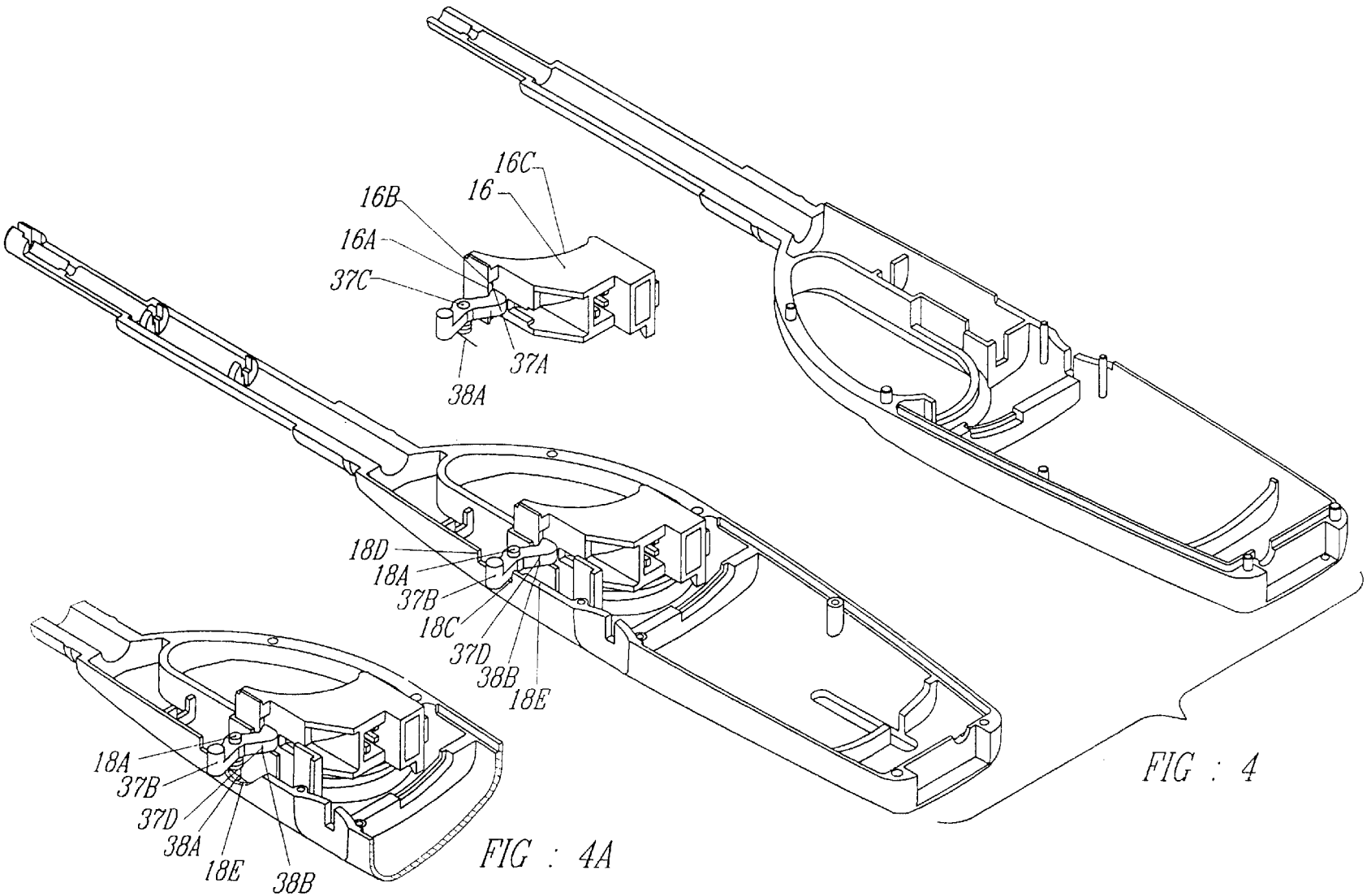
FIG. 4 is a perspective view of the components of the safety system of the present invention in the "safety on" position.
FIG. 4A is a detailed perspective view of the components of the safety system of the present invention in the "safety on" position.

FIG. 4A shows in detail the position of spring ends 38A and 38B withing the housing 18. The top end 38A and 38B extend the inner side 18E of housing 18 and lower end 38B urges against the side 37D of pin 37. The spring is held securely in place by wrapping around pillar 18A as the pillar body passes through the inner coil of the spring.

Figure 5:
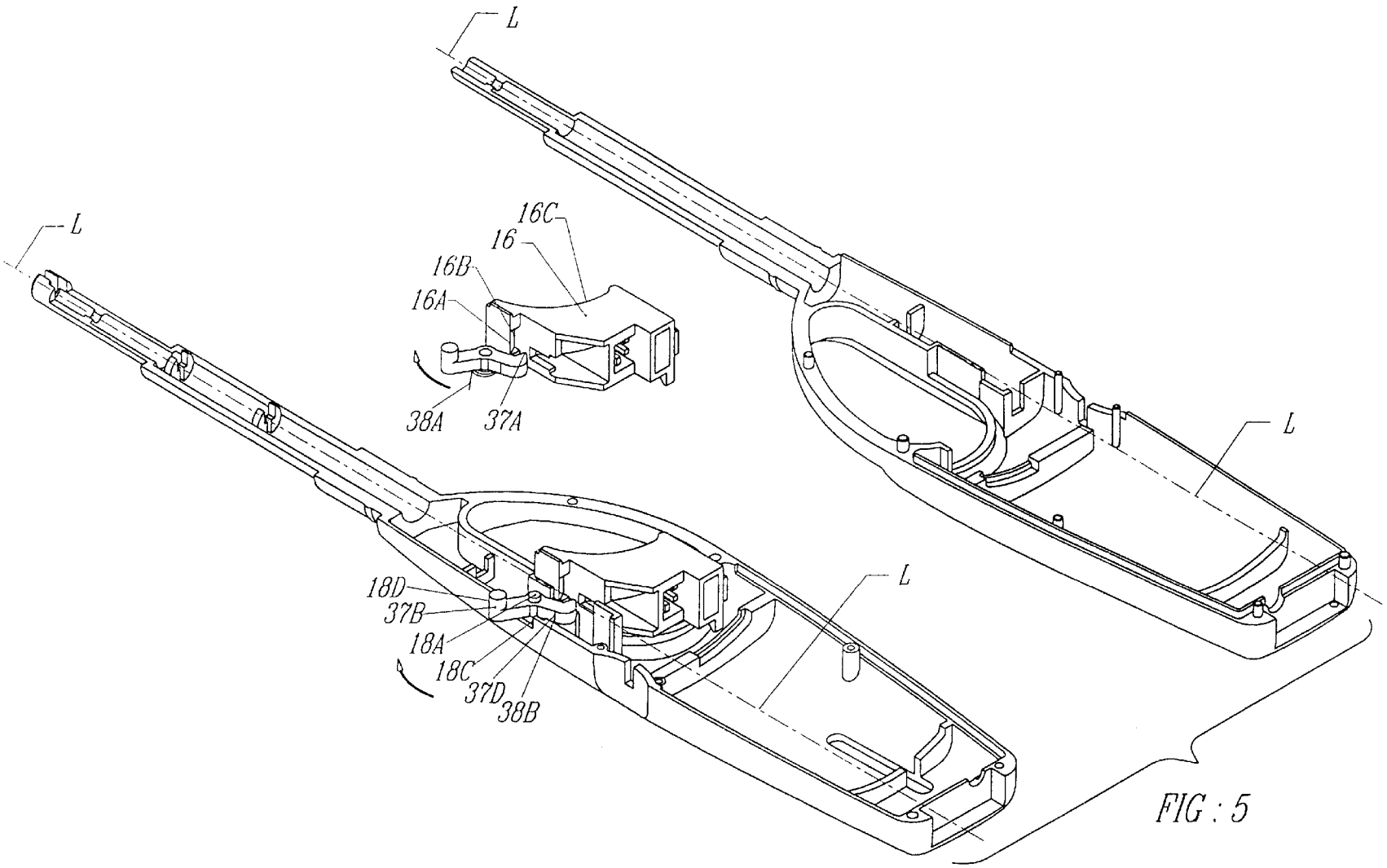
FIG. 5 is a perspective view of the components of the safety system of the present invention in the "safety off" position.

As shown in FIG. 5, a top 37B on the proximal end of pivotal pin 37 must be pressed forward parallel the longitudinal axis of the lighter 11 by the operator's thumb at the same time the fingers of the same hand rearwardly depress the trigger 16 parallel the longitudinal axis L. Foot 37A and hook 37F move rearward to disengage top edge 16A and slanted slot 16B of trigger 16. A narrow leg portion 37E of pin 37 pivots rearward bout positioning pillar 18 in housing 18. However, the spring action of spring 18 seeks to urge the pivot pin 37 back to the "safety on" position. The pivoting of the leg 37E, and foot 37A, and hook 37F, out of engagement with edge 16A and slanted slot 16B allows the trigger 16 to be depressed and the lighter 11 to ignite. This is a second position. This simultaneous operation of the safety pin 37 and trigger 16 requires more hand coordination than is normally achieved by a child.

Figure 6:
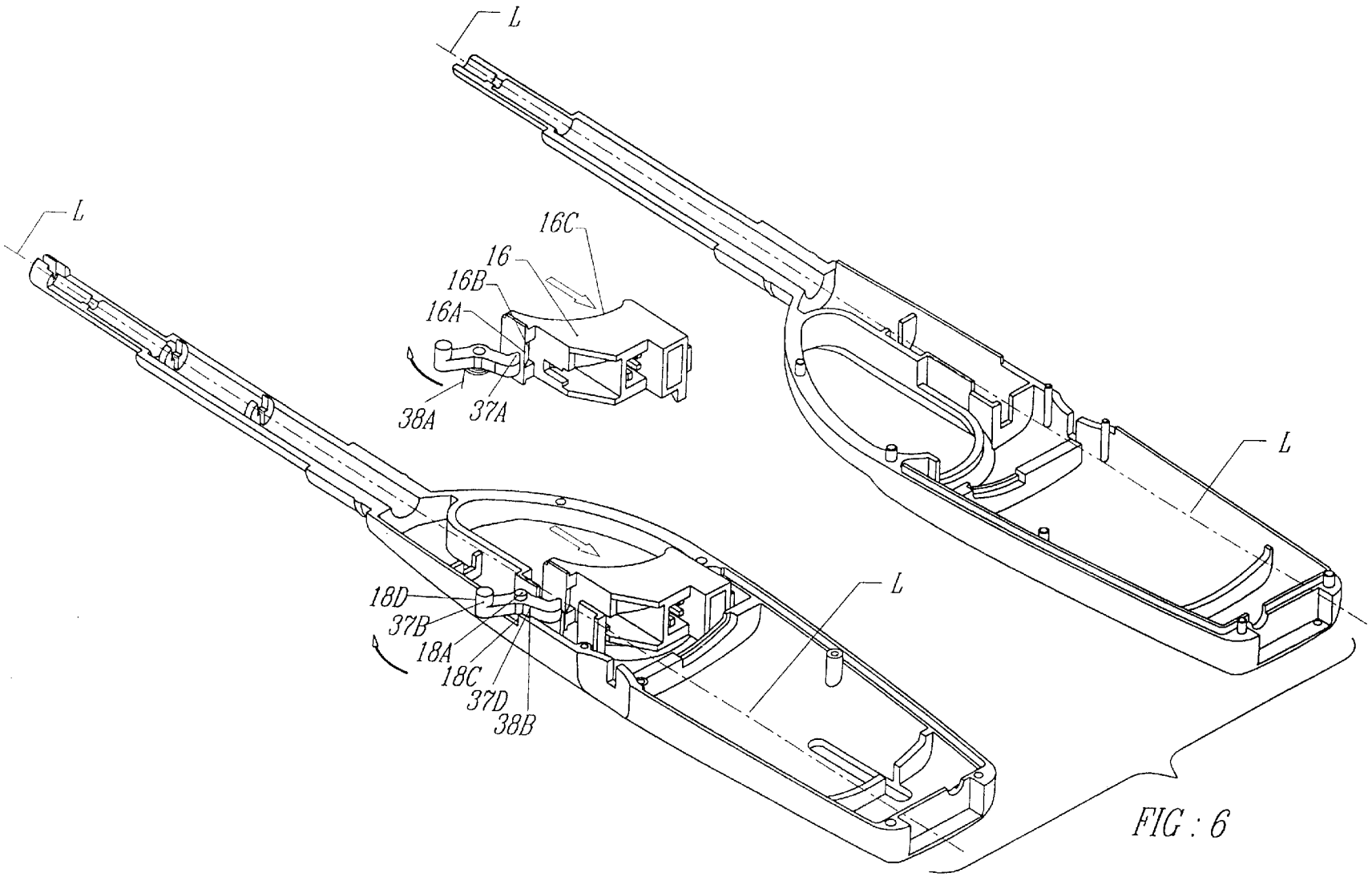
FIG. 6 is a perspective view of the components of the safety system of the present invention in a position where the safety is "off" and the trigger is urged rearwardly.

As shown in FIG. 6, when top 37B is released, leg 37E cannot pivot back while the trigger 16 is rearwardly depressed. Foot 37A cannot engage slanted slot 16B. As trigger 16 is urged rearward by the forefinger, simultaneously gas lever 19 is raised by the rearward motion of trigger 16 to release gas. Also, the engaging of trigger 16 activates the piezo effect of piezoelectric actuator 21 to discharge electric charge. The gas, as released, will meet with the spark produced to light a flame. This is the ignition condition in operation. Release of the forefinger after use will allow the trigger to return to off position, and pin 37 will automatically pivot back into the "safety on" position as shown in FIGS. 4 and 4A.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

What is claimed is:

1. A lighter with an ignition trigger operable within a trigger section of a housing in combination with a safety switch operable at a top section of said housing opposite said trigger section comprising:

a safety pin pivotable from a first position to a second position in said housing, said pin further comprising:

an engagement foot at a distal end of said pin, said foot having a hook and attached at the end of a narrow leg portion of said pin;

a positioning pillar opening extending through a mid portion of said pin; and a top at a proximal end of said pin extending outside said housing;

a torsional spring member positioned around a positioning pillar in said chamber to urge a first spring end against a side of said narrow leg portion and a second spring end against an inner side of said housing;

a slanted slot and a top edge in a wall of said trigger, said slot sized to receive said hook of said engagement foot, said hook aligned with said slot and said top edge such that when said pin is in said first position, said hook engages said top edge and said slanted slot of said wall to prevent the rearward pulling of said trigger to ignite said lighter and when said pin is pivoted forwardly to said second position by applying pressure to said top of said pin said spring member is torsionally compressed and said trigger may be simultaneously pulled to ignite said lighter, said hook disengaging said slot, said pin automatically returning to said first position with said hook engaging sad top end and said slanted slot upon release of said trigger and said top of said pin.

2. A lighter with an ignition trigger operable within a lighter housing comprising:

a safety pin pivotable from a first position to a second position in said housing when urged in a direction generally parallel to a longitudinal axis of said lighter, said pin further comprising:

an engagement foot at a distal end of said pin, said foot having a sharp hook and attached at the end of a narrow leg portion of said pin;

a positioning pillar opening extending through a mid portion of said pin; and a top at a proximal end of said pin extending outside said housing;

a torsional spring member positioned around a positioning pillar in said chamber to urge a first spring end against a face of said narrow leg portion and a second spring end against an inner side of said housing;

a slanted slot and a top edge in a wall of said trigger, said slot sized to receive said hook of said engagement foot, said hook aligned with said slot and top edge such that when said pin is in said first position, said hook engages said top edge and said slanted slot of said wall to prevent the rearward pulling of said trigger to ignite said lighter and when said pin is pivoted forwardly to said second position by applying pressure to said top of said pin said spring member is torsionally compressed and said trigger may be simultaneously pulled in an opposite direction generally parallel to said longitudinal axis of said lighter to ignite said lighter, said hook disengaging said slot, said pin automatically returning to said first position with said hook engaging sad top end and said slanted slot upon release of said trigger and said top of said pin.

3. A safety system for a lighter, said lighter housing an ignition trigger operable within a housing of said lighter comprising:

a safety pin pivotable from a first position to a second position in said housing urged in a direction generally parallel to a longitudinal axis of said lighter, said pin further comprising:

an engagement foot at a distal end of said pin, said foot having a sharp hook and attached at the end of a narrow leg portion of said pin;

a positioning pillar opening extending through a mid portion of said pin; and a top at a proximal end of said pin extending outside said housing;

a torsional spring member positioned around a positioning pillar in said chamber to urge a first spring end against a face of said narrow leg portion and a second spring end against an inner side of said housing;

a slanted slot and a top edge in a wall of said trigger, said slot sized to receive said hook of said engagement foot, said hook aligned with said slot and top edge such that when said pin is in said first position, said hook engages said top edge and said slanted slot of said wall to prevent the rearward pulling of said trigger to ignite said lighter and when said pin is pivoted forwardly to said second position by applying pressure to said top of said pin said spring member is torsionally compressed and said trigger may be simultaneously pulled in an opposite direction generally parallel to said longitudinal axis of said lighter to ignite said lighter, said hook disengaging said slot, said pin automatically returning to said first position with said hook engaging sad top end and said slanted slot upon release of said trigger and said top of said pin.

* * * * *